United States Patent [19]

Stiros

[11] 4,166,551

[45] Sep. 4, 1979

[54] MEANS FOR SHAPING AN INTERLEAVED STACK OF SHEETS TO IMPROVE THE POP-UP TYPE DISPENSING THEREOF

[75] Inventor: Paul Stiros, Cincinnati, Ohio

[73] Assignee: Procter & Gamble Company, Cincinnati, Ohio

[21] Appl. No.: 780,813

[22] Filed: Mar. 24, 1977

[51] Int. Cl.[2] ..... B65D 85/16

[52] U.S. Cl. ..... 221/51

[58] Field of Search ..... 221/63, 47-51, 221/58-60; 118/423; 206/210, 494; 225/106

[56] References Cited

U.S. PATENT DOCUMENTS

| | | | |
|---|---|---|---|
| 1,228,571 | 6/1917 | Lazar | 221/51 |
| 1,331,112 | 2/1920 | Lazar | 221/51 |
| 2,852,158 | 9/1958 | Jones et al. | 221/59 X |
| 3,207,361 | 9/1965 | Marcalus | 221/48 |

*Primary Examiner*—Stanley H. Tollberg
*Attorney, Agent, or Firm*—Frost & Jacobs

[57] ABSTRACT

Means for shaping a stack of discrete interleaved sheets to improve the pop-up type dispensing thereof from a package containing the stack and having a dispensing orifice thereabove. The sheets are characterized by such stiffness that, when arranged in a conventional interleaved stack wherein the interleaved sheet portions are substantially planar and horizontal, during the removal of a given sheet from the stack through the package dispensing orifice the portion of the next succeeding sheet overlying a portion of the sheet being removed tends near its adjacent folded edge to lift away from the sheet being removed, permitting the sheet being removed to slip out from under the succeeding sheet, resulting in failure of the succeeding sheet to achieve its pop-up position through the dispensing orifice. The means to shape the stack comprises support means for the stack so configured as to cause the central portion of the stack to be depressed so that the interleaved portions of the sheets are non-planar and are concave in at least one plane in which the vertical axis of the package lies.

3 Claims, 12 Drawing Figures

MEANS FOR SHAPING AN INTERLEAVED STACK OF SHEETS TO IMPROVE THE POP-UP TYPE DISPENSING THEREOF

BACKGROUND OF THE INVENTION

1. Field of the Invention

The invention relates to means to improve the pop-up type dispensing of sheets arranged in an interleaved stack, and more particularly to means to shape the stack to minimize dispensing failure.

2. Description of the Prior Art

The teachings of the present invention are directed to a pop-up type dispensing package for a stack of discrete, interleaved sheets. The present invention is particularly applicable in instances where the sheets themselves are characterized by a stiffness which may be defined for purposes of this disclosure and the claims that follows as being such that, when the sheets are arranged in a conventional interleaved stack wherein the interleaved sheet portions are substantially planar and horizontal, during the removal of a given sheet from the stack through the package dispensing orifice the portion of the next succeeding sheet overlying a portion of the sheet being removed tends near its adjacent folded edge to lift away from the sheet being removed, permitting the sheet being removed to slip out from under the succeeding sheet. This results in failure of the succeeding sheet to achieve its pop-up position through the dispensing orifice.

Sheets demostrating such stiffness are well known in the art and the material from which such sheets are made does not constitute a limitation on the present invention. For example, sheets demonstrating such stiffness may be made of paper, film, woven or nonwoven natural or synthetic fibers, or the like. The stiffness characteristics of the sheet may result from its composition, the fibers used, the binder used, materials with which the sheet is pretreated or the like, all as is well known in the art.

Sheets demonstrating stiffness of the type described above are frequently chosen for various ones of their properties such as strength, resistance to tearing and the like. In recent years there has been increased interest in sheets, towelettes or the like pre-moistened with a volatile component. The composition and purpose of the volatile component may vary widely. Non-limiting examples of such volatile components may include perfume, cleaning compound, wax, insecticide or insect repellent, topical medicaments and cosmetics. Generally, such pre-moistened sheets demonstrate the sort of stiffness contemplated by the present invention by virtue of their composition so that they are compatible with the solvent of the volatile component, because of their strength and durability so that they may be used as wipes or the like and because of their pleasing appearance and tactile properties.

Pre-moistened sheets have been packaged in numerous ways. For example, U.S. Pat. No. 3,499,575 in the name of Winston G. Rockefeller, issued Mar. 10, 1970 teaches a container for pre-moistened sheets having a reclosable lid to prevent evaporation of the volatile component with which the sheets are pre-moistened. The sheets are arranged in the container in a non-interleaved stack and a support member is provided in the container for the stack to raise the central portion of the stack to facilitate withdrawal of the individual sheets from the container. Pre-moistened sheets have also been arranged in a conventional, interleaved, flat stack in a container having a dispensing orifice providing pop-up dispensing of the individual sheets. In such instances, however, should be given sheet be withdrawn from the stack by the consumer and the next succeeding sheet fail to achieve its pop-up position in the container orifice, the orifice is usually so sized that the next succeeding sheet can be restarted by the consumer with his fingers. An example of this type of package is taught in U.S. Pat. No. 3,780,908 in the name of William E. Fitzpatrick, Leonard Berger and Hayward B. Auerbach, issued Dec. 25, 1973.

While it will be understood by one skilled in the art that the teachings of the present invention are not intended to be restricted to a pop-up type dispensing package for a stack of interleaved, pre-moistened sheets (the invention being equally applicable to such a package containing interleaved dry sheets demonstrating the above mentioned tendency to lift by virtue of their stiffness), the invention will be described for purposes of an exemplary showing in its application to a package of the type taught in the commonly owned copending application Ser. No. 711,929, filed Aug. 5, 1976, in the name of Robert F. McCarthy and entitled PACKAGE FOR DISCRETE PRE-MOISTENED INTERLEAVED SHEETS AND THE POP-UP DISPENSING THEREOF.

Briefly, the above mentioned copending application teaches a moisture-proof package of discrete, interleaved, pre-moistened product sheets. The package comprises a tray-like portion to receive the sheet stack and a cover usually sealed to the tray-like portion. The cover is provided with a dispensing opening so dimensioned as to enable twice the cross sectional area of a pre-moistened sheet (i.e. two pre-moistened sheets in tightly gathered form) to pass therethrough without such undue friction as would cause the sheets to jam, tear or separate before the next succeeding sheet is presented for subsequent removal. The succeeding sheet not only is presented for subsequent removal, but also serves in the meantime as a plug for the dispensing opening, minimizing evaporation of the volatile composition with which the sheets have been pre-moistened. No additional closure or lid is required to be closed by the consumer to prevent dry-out.

The package of the above mentioned copending application serves as an excellent example of a package to which the teachings of the present invention may be applied not only because the sheets contemplated for use therewith would normally demonstrate the sort of stiffness described above, but also because the restricted dispensing opening is too small for the operator to conveniently reach therethrough to restart a succeeding sheet, should the succeeding sheet fail to achieve its pop-up position through the dispensing orifice. Reliability of the pop-up type dispensing of this exemplary package is of considerable importance because it is preferred that the cover be permanently or semi-permanently sealed to the tray-like portion of the package.

The present invention is based upon the discovery that if means are provided to support and so configure the stack as to cause the central portion of the stack to be depressed so that the interleaved portions of the sheets are non-planar and are concave in at least one plane in which the vertical axis of the package lies, failure of the pop-up type dispensing of the sheets will be greatly minimized or eliminated.

SUMMARY OF THE INVENTION

The present invention is directed to the improvement of the reliability of the pop-up type dispensing of discrete sheets from a package containing an interleaved stack of the sheets and having a dispensing orifice above the sheet stack.

The sheets are characterized by such stiffness that, when arranged in a conventional interleaved stack wherein the interleaved sheet portions are substantially planar and horizontal, during the removal of a given sheet from the stack through the package dispensing orifice the portion of the next succeeding sheet overlying a portion of the sheet being removed tends near its adjacent folded edge to lift away from the sheet being removed. This permits the sheet being removed to slip out from under the succeeding sheet, resulting in failure of the succeeding sheet to achieve its pop-up position through the dispensing orifice. The invention is based upon the discovery that this lifting of the second sheet away from the sheet being withdrawn through the dispensing orifice is prevented or greatly minimized by providing means to so configure the stack of sheets as to cause the central portion of the stack to be depressed so that the interleaved portions of the sheets are non-planar and are concave in at least one plane in which the vertical axis of the package lies. This configuring of the stack of sheets is acccomplished by providing support means for the stack which will so configure the stack. The support means may comprise an integral part of the package, or the support means may comprise a separate support located within the package beneath the sheet stack.

The support means may be so arranged or configured as to raise those opposite sides of the stack containing the folds of the interleaved sheets with the center of the stack being depressed. Similarly, the support means may be so arranged or configured as to raise the other two opposite sides of the stack with the center portion of the stack being depressed. Finally, the support means may be so configured or arranged as to raise all four sides of the stack with the center portion of the stack being depressed. It will be evident that the support means may take numerous forms, as will be described hereinafter.

DESCRIPTION OF THE PREFERRED EMBODIMENTS

Figure 1:
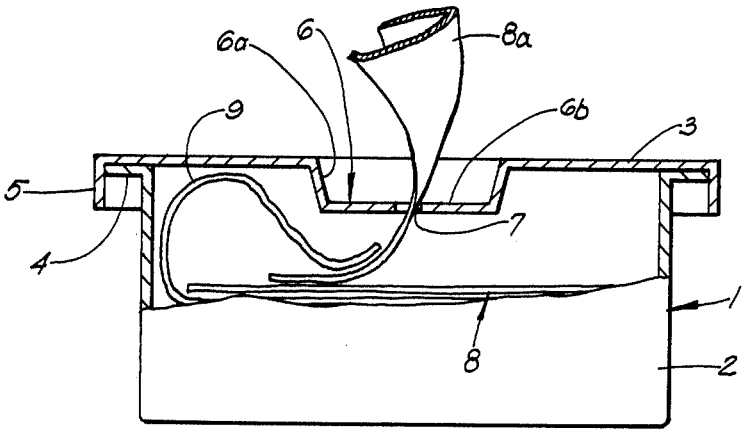
FIG. 1 is a fragmentary elevational view, partly in cross section, illustrating an exemplary package to which the teachings of the present invention are applicable.

Reference is made to FIG. 1 which illustrates an exemplary package to which the teachings of the present invention may be applied and which corresponds to the above mentioned copending application Ser. No. 711,929.

The package is generally indicated at 1 and comprises a rectangular tray 2 and a cover member 3. Since the package is intended to contain a stack of pre-moistened sheets, the material from which the package is made will depend upon the nature of the volatile component with which the sheets are pre-moistened and should be compatible therewith and impervious thereto. The tray and cover members for example, may be made of rigid or semi-rigid plastic, paper board laminates, or combinations of paper board and film or paper board and rigid or semi-rigid plastics.

The tray 2 has about its upper edge a laterally extending peripheral flange 4. The cover is provided with a downwardly depending peripheral flange 5 and is so sized as to just nicely receives the flange 4 of tray 2. Once a stack of sheets has been located within the tray 2, the cover 3 will be located thereon and will be heat, adhesively or machanically sealed to the tray flange 4, depending upon the nature of the material from which the tray 2 and cover 3 are made.

The upper surface of cover 3 has a depression (generally indicated at 6) formed therein. The configuration of the depression 6 does not constitute a limitation. For purposes of any exemplary showing, the depression is illustrated as being circular with an annular inwardly and downwardly sloping wall 6*a* and a substantially planar bottom 6*b*.

A dispensing orifice 7 is located in the bottom 6*b* of depression 6. The dispensing orifice may be of any appropriate configuration, although it is preferred that the dispensing orifice be circular or oval. As taught in the above mentioned copending application Ser. No. 711,929, the size of the dispensing orifice 7 is critical. The orifice should be so sized as to permit twice the cross sectional area of a pre-moistened sheet (i.e. two pre-moistened sheets in tightly gathered form) to pass therethrough. It will be understood that this refers to the cross sectional area of the sheet being extracted from the package and of the next succeeding sheet being pulled to pop-up position. The dispensing orifice 7 should be so sized that the force required to pull a tightly gathered double thickness of the sheets therethrough is not so great as to be inconvenient to the consumer. The tightly gathered double thickness of the sheets should pass through the orifice 7 without such undue friction as would cause the sheets to jam, tear or as would cause the sheets to separate until the sheet being extracted has cleared the orifice. Thus, the orifice size will be selected to achieve maximum restriction and still maintain easy dispensing, depending upon the orifice wall texture, the texture of the pre-moistened sheets and the lubricating properties of the volatile compound with which the sheets are pre-moistened. It will be evident from the above that the orifice 7 will be of a size such that the consumer could not reach therethrough with his fingers to restart a sheet, should the pop-up type dispensing fail.

In the use of a package of the type illustrated in FIG. 1, when a given sheet is extracted from orifice 7, it is desirable that a sufficient amount of the succeeding sheet be drawn through the orifice so that it may be conveniently grasped and extracted by the consumer at a later time. In addition, that portion of each sheet which is pulled through the orifice 7 in gathered form by the previously extracted product sheet will serve as a plug for the orifice, minimizing dry-out of the remainder of the sheets within the tray 2, without necessitating an additional releasable flap, hinged cover or plug-type closure for the package. Thus, the package 1 is intended to provide a means for reliably dispensing individual wet sheets while protecting the reserve sheets from evaporation of the volatile composition with which they have been pre-moistened.

In FIG. 1 a stack of interleaved sheets is generally indicated at 8. It will be understood by one skilled in the art that the thickness of the sheets is greatly exaggerated for purposes of clarity and hence their number is fewer. FIG. 1 also illustrates, in semi-diagramatic form, the nature of the problem to which the present invention is directed.

The stack 8 is conventional, each of the interleaved sheets being formed into a simple V-fold. The sheet halves are substantially planar and horizontal. In FIG. 1 a sheet 8*a* is fragmentarily shown in the process of being withdrawn through the restrictive dispensing orifice 7. When the pop-up type dispensing functions properly, the trailing portion of sheet 8*a* should carry with it the leading portion of the next succeeding sheet 9, tending to gather and surround the leading portion of sheet 9. However, when the sheets of stack 8 are characterized by the stiffness described above, sheet 9 will have a tendency near its folded portion to lift or "bubble" upwardly away from the trailing portion of sheet 8*a*. When this occurs to a sufficient extent, the trailing portion of sheet 8*a* may simply slip out from under the leading portion of the next succeeding sheet 9, failing to draw the leading portion of sheet 9 through dispensing orifice 7 to its pop-up position. As a consequence of this, a dispensing failure occurs. The consumer is then required to force open the package 1 and to restart the leading portion of sheet 9 through the restrictive orifice 7. When the package is full the first number of sheets generally dispense properly with the next succeeding sheet achieving its proper pop-up position. This is true because there is not sufficient room in the package for the succeeding sheet to lift or "bubble". As the stack is depleted, however, the amount of room within the package increases, and the chance of dispensing failure also increases. In FIG. 1 the stack 8 is shown with a sufficient number of sheets having been withdrawn therefrom to permit the succeeding sheet 9 to lift or "bubble" as described.

Figure 2:
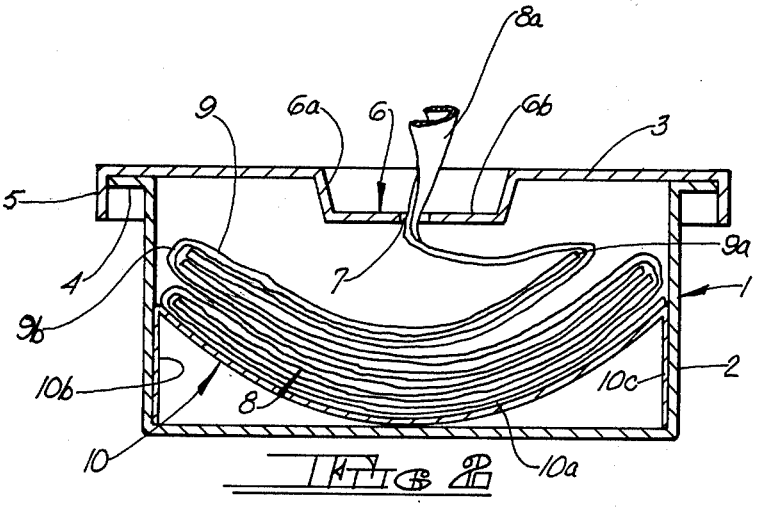
FIG. 2 is a fragmentary cross sectional view of the package of FIG. 1 provided with one embodiment of the stack supporting means of the present invention.

The present invention is based upon the discovery that this type of dispensing failure can be greatly minimized if means are provided to so configure the stack as to cause the central portion of the stack to be depressed so that the interleaved portions of the stack are non-planar and are concave in at least one plane in which the vertical axis of the package lies. Reference is now made to FIG. 2 which illustrates a package identical to that of FIG. 1 and like parts have been given like reference numerals. In FIG. 2, the package has been provided with a stack-shaping support generally indicated at 10 and receivable within tray 2. The support 10 provides a concave supporting surface 10*a* for the stack and has at least a pair of downwardly depending legs 10*b* and 10*c* resting on the bottom of tray 2. The support 10 may be made of any appropriate material compatible with the volatile composition with which the sheets of stack 8 are pre-moistened and capable of retaining its shape. For example, the support 10 may be made of rigid or semi-rigid plastic, paperboard liminates, combinations of paperboard and film or paperboard and rigid or semi-rigid plastics, or the like. If the support 10 is a molded structure, it may be provided with downwardly depending legs on all four sides.

It will be noted that the support 10 is so configured as to raise those sides of the stack 8 incorporating the folded edges of the sheets and to lower the central portion of the stack. Thus, the stack is concave in a plane in which the vertical axis of the package 1 is located, the plane being perpendicular to the leading and trailing edges of the individual sheets of the stack.

It has been found that when the stack is configured in the manner shown in FIG. 2, pop-up dispensing failure is greatly minimized. This is true even after partial depletion of the stack 8 (as illustrated in FIG. 2) so that there would otherwise be room within the package 1 for succeeding sheet 9 to lift or "bubble". While not wishing to be bound by theory, it is believed that succeeding sheet 9 achieves its proper pop-up position because it is preformed into a concave configuration by support 10 and hence is biased against lifting or "bubbling". As sheet 8*a* is removed through dispensing orifice 7 the distance between leading edge 9*a* of succeeding sheet 9 and its folded portion 9*b* must diminish and the portion of sheet 9 overlying sheet 8*a* will tend to continue its downward bending as initiated by support 10.

Figure 3:
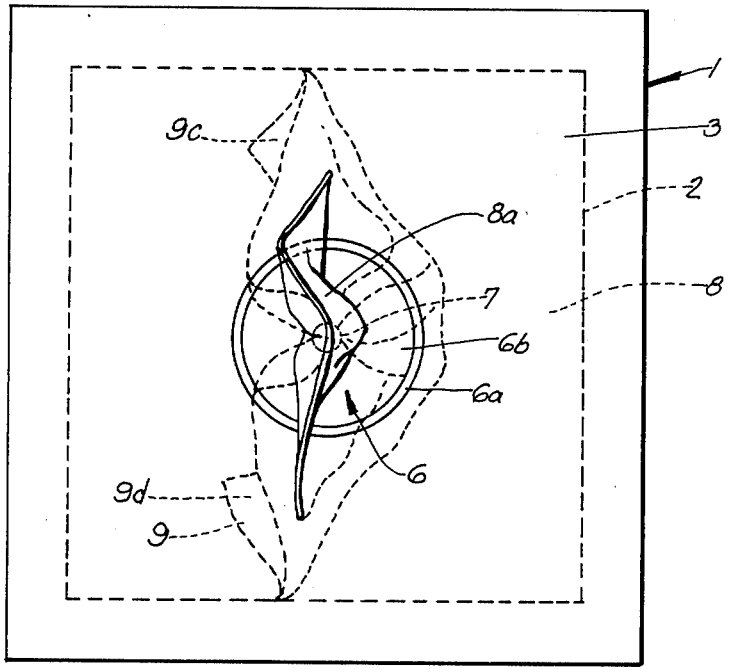
FIG. 3 is a plan view of the package of FIG. 2, illustrating the relative positions of the topmost sheet of the stack and the next succeeding sheet during removal of the topmost sheet.

FIG. 3 is a plan view of the structure of FIG. 2. Again, like parts have been like reference numerals. It will be noted from FIG. 3 that as the sheet 8*a* is withdrawn through dispensing orifice 7, it will tend to gather the leading end of sheet 9. In FIG. 3 the leading corners of sheet 9 are shown at 9*c* and 9*d* and it will be noted that the sheet 8*a* is beginning to gather these corners inwardly and toward each other. Ultimately, the trailing end of sheet 8*a* will gather about the leading end of sheet 9, drawing the leading end of sheet 9 through the restrictive dispensing orifice 7 to its pop-up position.

It is also possible to orient the stack 8 on the support 10 at 90° with respect to the position shown in FIG. 2.

In this instance, those sides of stack 8 which do not incorporate the folds of the sheets are raised upwardly and the central portion of the stack are depressed. The stack would therefore be concave in a plane passing through the vertical axis of the stack and being parallel to the leading and trailing edges of the individual sheets of the stack.

Figure 4:
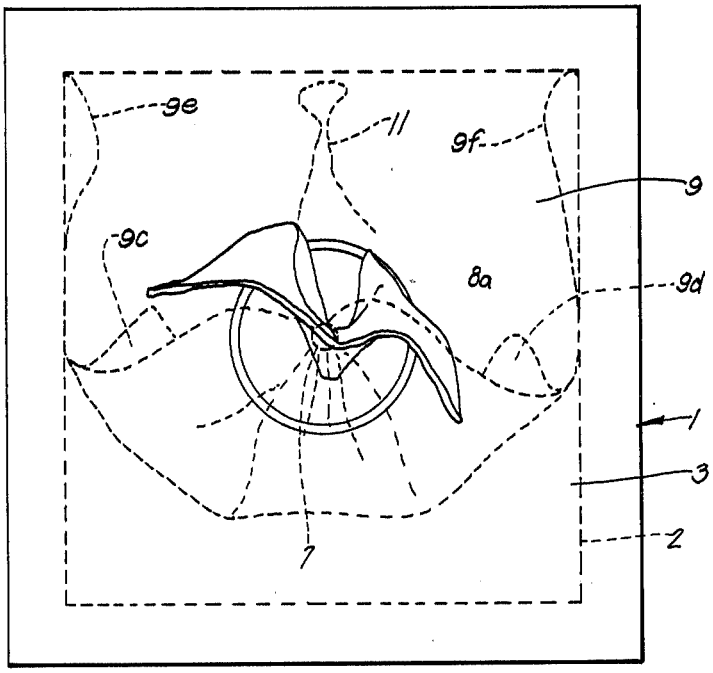
FIG. 4 is a plan view similar to FIG. 3 and illustrating the relative positions and conditions of the topmost sheet and the next succeeding sheet during removal of the topmost sheet when the stack of FIG. 2 is turned 90° with respect to the support.

It has been found that a stack so oriented on support 10 also demonstrates marked improvement is reliability of its pop-up type dispensing through restrictive dispensing orifice 7. This is again true after the stack has been sufficiently depleted to create sufficient room within package 1 for the leading portion of a succeeding sheet to "bubble" or lift away from the trailing portion of the sheet being withdrawn through restrictive dispensing orifice 7. It is believed that the reason for improved dispensing reliability lies in the fact that the overall fold or depression of the stack 8 intersects the folds of the sheets. This is most clearly shown in FIG. 4 wherein again like parts have been given like reference numerals. It will be understood that FIG. 4 is identical to FIG. 3 with the exception that the stack 8 has been turned 90° with respect to its position on support 10 shown in FIGS. 2 and 3. As is evident from FIG. 4, since the overall fold or depression of the stack now runs between those sides of the stack containing the sheet folds, as the sheet 8*a* is withdrawn from the restrictive dispensing orifice 7 it will again tend to gather the leading corners 9*c* and 9*d* of succeeding sheet 9 toward the dispensing orifice. While the sides of succeeding sheet 9 near its folded edge may tend to lift or "bubble" as at 9*e* and 9*f* the majority of the sheet 9 near its folded edge is precluded from lifting significantly by virtue of the fact that a fold or crease is formed in it perpendicular to its folded edge. This fold or crease is indicated at 11. As a consequence, the leading portion of sheet 9 is precluded from lifting to the extend that the trailing portion of sheet 8*a* can slip out from under it.

Figure 5:
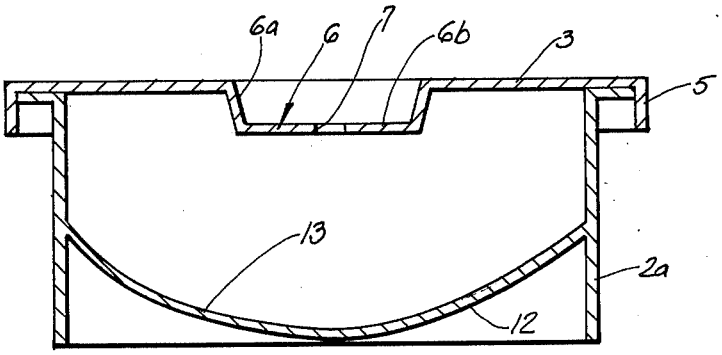
FIG. 5 is a cross sectional elevational view of a package similar to that of FIG. 2 wherein the support means constitutes an integral part of the package.

FIG. 5 illustrates a package similar to that of FIG. 1. The package comprises a tray-like portion 2*a* and a cover which is identical to the cover 3 of FIG. 1 and which has been given the same reference numerals. The tray 2*a* differs from the tray 2 of FIG. 1 in that its bottom 12 is inset from the bottom edges of its sides and is configured to present a supporting surface 13 identical to the concave portion 10*a* of support 10 of FIG. 2. This simply illustrates that the concave support may constitute an integral part of the package rather than a separate element located within the package such as support 10 of FIG. 2.

Figure 6:
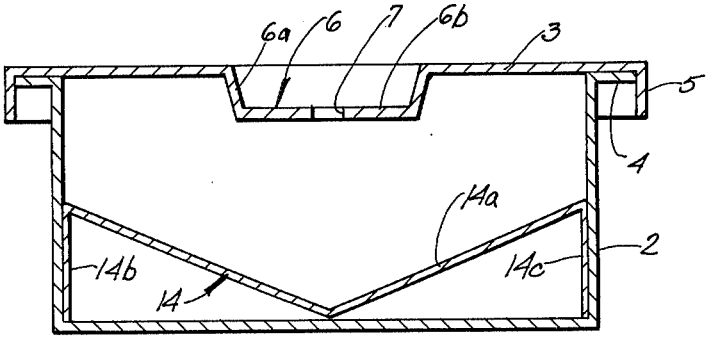
FIG. 6 is a cross sectional elevational view of a package similar to that of FIG. 2 provided with another embodiment of stack support means.

FIG. 6 illustrates a package identical to that of FIG. 2 and again like parts have been given like reference numerals. In this instance, the package 2 is provided with a support or insert generally indicated at 14 providing a V-shaped support surface 14*a* and having at least two downwardly depending legs 14*b* and 14*c*. It will be immediately evident that the support 14 will configure a stack of sheets (not shown) in substantially the same manner illustrated in FIG. 2. The amount by which the supporting surface for the stack causes the central portion of the stack to be depressed can be varied (by varying the configuration of the stack supporting surface) depending upon the nature of the sheets to be dispensed and their stiffness, as defined above. The amount by which the center of the stack is depressed to achieve the best dispensing characteristics may be readily determined by one skilled in the art for the particular application to which the teachings of the present invention are to be directed. It will further be understood by one skilled in the art that the stack of sheets can be oriented on the support portion 14*a* of support 14 of FIG. 6 in either of the ways illustrated in FIGS. 3 and 4 and the sheets, during the dispensing operation, will perform in the manner described above with respect to either FIG. 3 or FIG. 4. The support 14 may be made of any appropriate and compatible material as described with respect to support 10 of FIG. 2.

Figure 7:
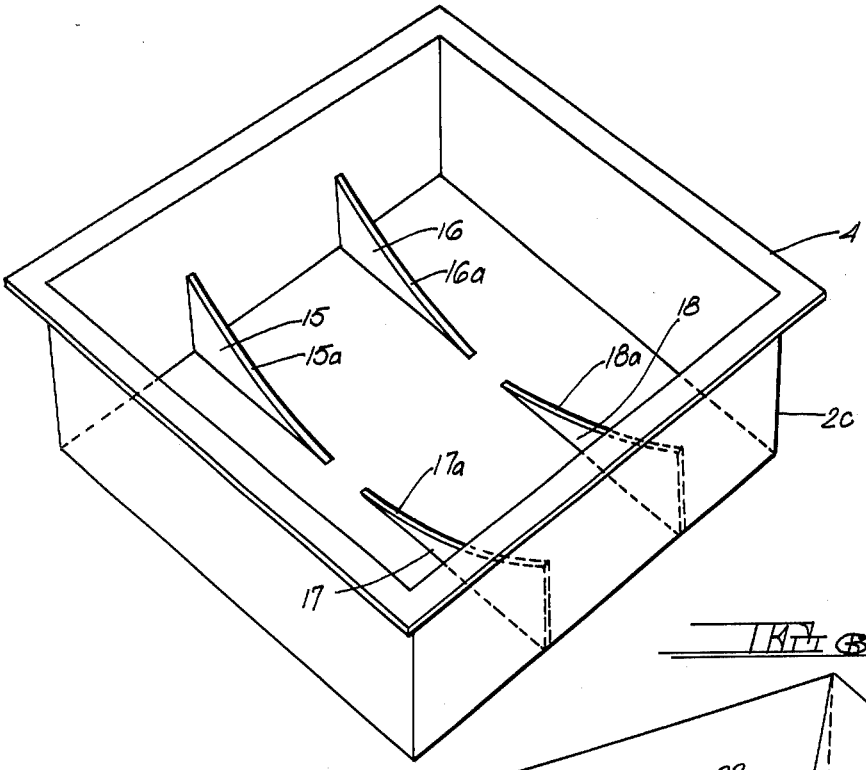
FIG. 7 is a perspective view of the tray-like portion of a package of the type illustrated in FIGS. 1 and 2, provided with another embodiment of stack support means.

FIG. 7 is a perspective view of a tray 2*c* similar to the tray 2 of FIGS. 1, 2 and 6. The tray 2*c* is provided with a first pair of identical wedge-shaped supports 15 and 16 and a second pair of similar wedge-shaped supports 17 and 18. The supports 15 and 16 extend inwardly from one side of the tray 2*c* while the supports 17 and 18 extend inwardly from the opposite side of the tray. The supports 15 and 17 may be coplanar and the supports 16 and 18 may similarly be coplanar.

The upper edges 15*a* through 18*a* of wedge-shaped supports 15 through 18 will serve as supports for a stack of sheets such as that shown at 8 in FIG. 2. If the upper edges 15*a* through 18*a* are arcuate as illustrated, the supports 15 through 18 will be essentially equivalent to the support surface 10*a* of support 10 of FIG. 2 or the support surface 13 of integral support 12 of FIG. 5. If the upper surfaces 15*a* through 18*a* of supports 15 through 18 are straight, sloping downwardly and inwardly, they would be more nearly equivalent to the support surface 14*a* of support 14 of FIG. 6.

The supports 15 through 18 may be affixed in place within tray 2*c* by adhesive means or the like, or they may constitute integral parts of the tray 2*c*. It would also be within the scope of the invention to make the opposed supports of each pair (i.e. supports 15 and 17 and supports 16 and 18) one-piece integral elements affixed to the tray 2*c* or constituting integral parts of tray 2*c*. The supports 15 through 18 will operate in substantially the same manner described with respect to the support 10 of FIG. 2 or the supports 13 and 14 of FIGS. 5 and 6. A stack of interleaved sheets may be oriented on supports 15 through 18 either in the manner illustrated in FIGS. 2 and 3 or in the manner illustrated in FIG. 4.

Figure 8:
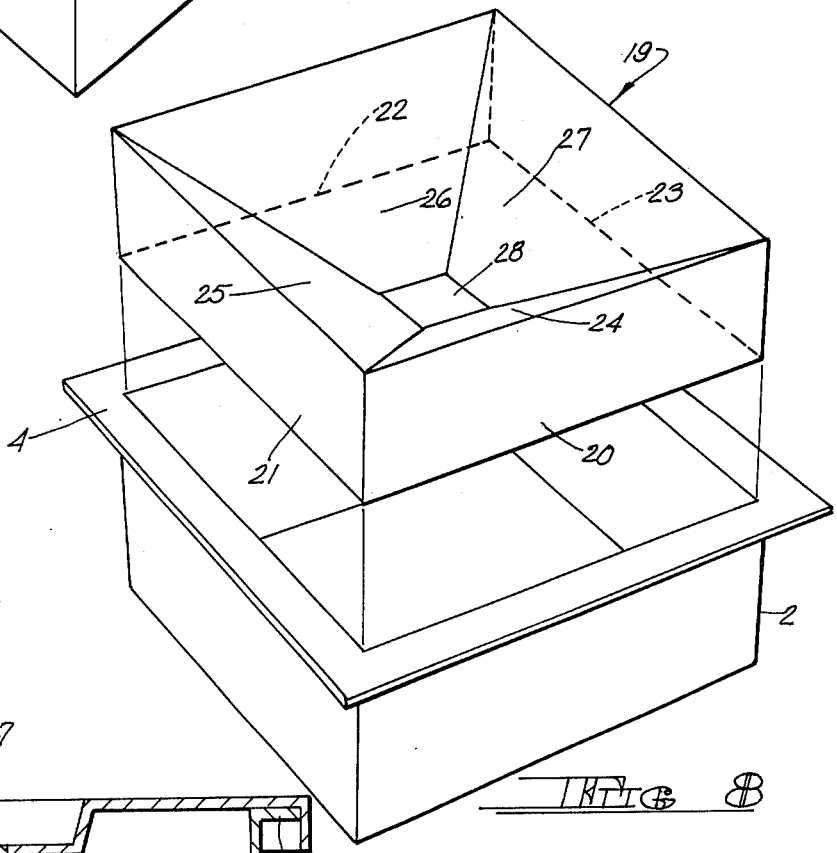
FIG. 8 is an exploded perspective view illustrating a package of the type shown in FIG. 1 and yet another embodiment of stack support means therefor.

FIG. 8 illustrates a tray identical to that of FIGS. 1 and 2 and again like parts have been given like reference numerals. The tray is intended to be provided with a cover (not shown) which may be identical to the cover 3 of FIGS. 1 and 2.

FIG. 8 also illustrates an insect-type support generally indicated at 19. The support 19 has four sides or legs 20 through 23 adapted to be just nicely received within tray 2 and to rest upon the bottom of the tray. The insert 19 is provided with inwardly and downwardly sloping surfaces 24 through 27 which extending from the upper edges of legs 20 through 23, respectively, to a central, substantially horizontal, bottom surface 28.

It will be immediately evident that it will make no difference how a stack of sheets is oriented on the support 19 and that the support 19 will configure a stack supported thereon so as to be substantially arcuate in all vertical planes containing the vertical axis of tray 2. As a result, the reliability of the pop-up type dispensing of the sheets of the stack will be markedly improved for the reasons given both with respect to FIG. 3 and with respect to FIG. 4. The support 19 will cause the stack to be raised along all four of its sides and to have a depressed center. The support 19 therefore combines the advantages achieved when a stack of sheets is mounted on the support 10 of FIG. 2 in the manner described with respect to FIG. 3 and when a stack of sheets is mounted on the support 10 of FIG. 2 in the manner described with respect to FIG. 4.

Figure 9:
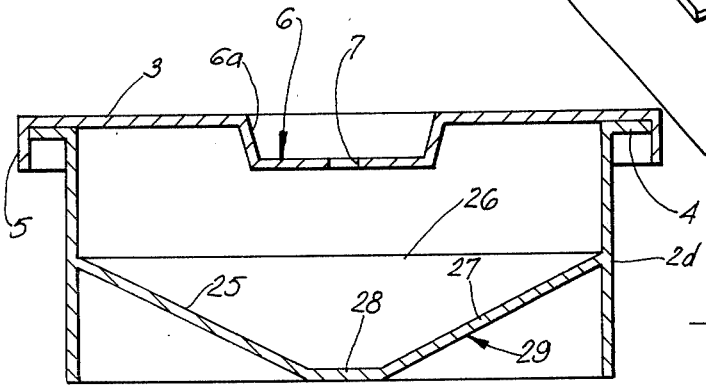
FIG. 9 is a cross sectional elevational view of a package similar to that of FIG. 1 and provided with a stack support means similar to that of FIG. 8 but constituting an integral part of the package.

The support 19 of FIG. 8 may constitute an integral part of the tray 2. This is illustrated in FIG. 9 wherein the tray **2*d* has a bottom (generally indicated at 29) inset from the bottom edges of its sides and configured to be equivalent to the surfaces 24 through 28 of insert 19 of FIG. 8. The equivalent surfaces of integral bottom 29 are given like reference numerals. Only surface 24 is not shown in FIG. 9. It will be understood that the tray 2*d* may be provided with a cover identical to cover 3 of FIG. 1 and again like parts have been given like reference numerals. As will be most clearly understood from FIG. 9, when a support of the type shown at 19 in FIG. 8 or of the type shown at 29 in FIG. 9 is used, the stack of sheets (since all four sides of the stack are raised) will not as easily assume its configured condition. The depression 6 of cover 3** will initially assist the stack in assuming the desired depressed-center configuration.

The support 19 of FIG. 8 can be made of any of the materials described with respect to the support 10 of FIG. 2, the materials being appropriately selected to be compatible with the volatile composition with which the sheets are pre-moistened when pre-moistened sheets are used. If the support 19 is molded of plastic or the like, it will be understood that the supporting surfaces 24 through 28 could be so configured as to constitute a single uninterrupted surface. The same is of course true of the integral support 29 of FIG. 9.

Figure 10:
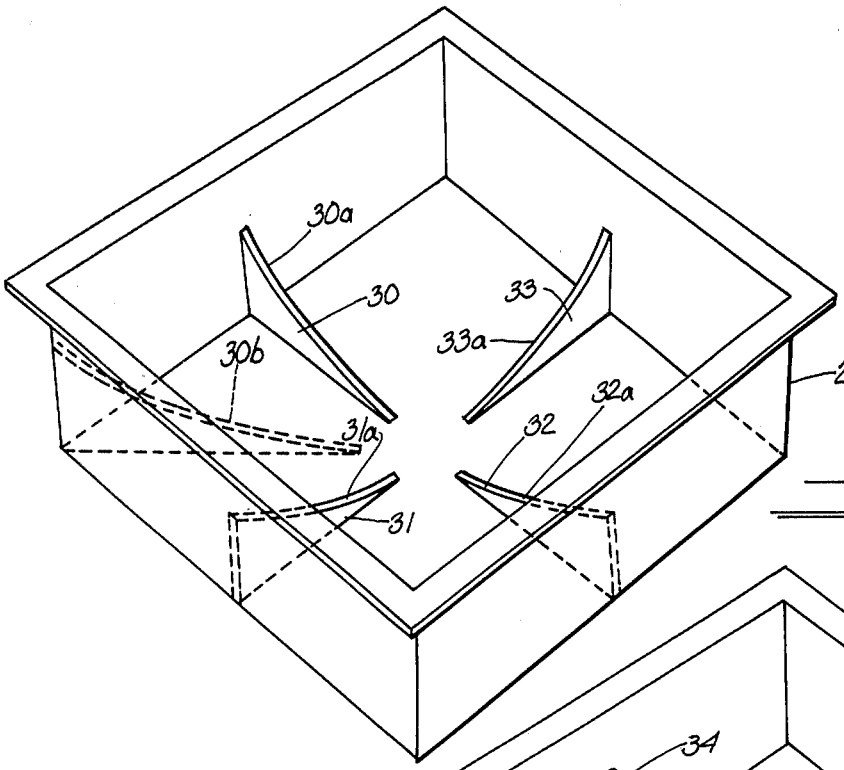
FIG. 10 is a perspective view similar to that of FIG. 7 and illustrates another form of stack support means.
Figure 11:
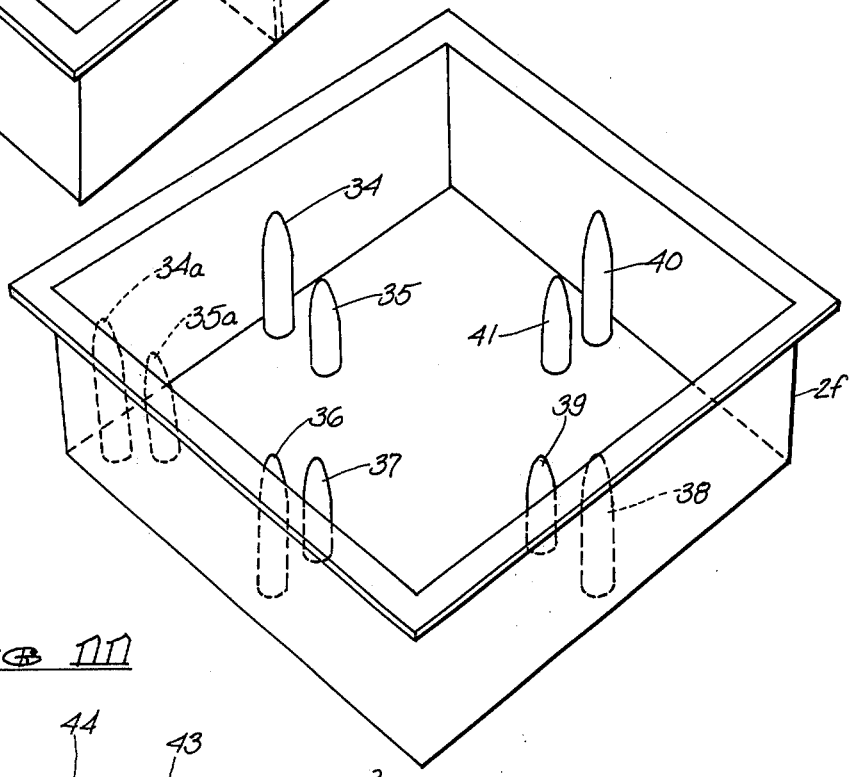
FIG. 11 is a perspective view similar to that of FIG. 10 and illustrates a modified stack support means comparable to that of FIG. 10.

FIGS. 10 and 11 illustrate modifications of the type of supportthe same as the tray 2 of FIGS. 1, 2, 6 and 8 and may be used with a cover (not shown) of the type illustrated at 3 in FIG. 1. The tray **2*e* differs from those previously described only in that it is provided with four substantially identical wedge-shaped supports 30 through 33, each support extending inwardly from the center of one of the tray walls toward the center of the tray bottom. The supports 30 through 33 may be separate elements appropriately affixed to tray 2*e* by adhesive means or the like, or they may each be an integral of the tray. The upper edges 30*a* through 33*a* of the supports 30 through 33 will serve the same purpose as the surfaces 24 through 27 of the support 19 of FIG. 8. It will be understood that the wedge-shaped supports 30 through 33 could be so positioned as to extend inwardly from the corners of tray 2*e* along the diagonals thereof. One such wedge-shaped support so positioned is shown in broken lines at 30*b***.

FIG. 11 illustrates yet another modification of the support means of the present invention closely related to the support means of FIGS. 8 through 10. In this instance the tray **2*f*, otherwise identical to tray 2*e* of FIG. 10, is provided with pairs of upstanding spikes 34–35, 36–37, 38–39, and 40–41. While the spikes 34 through 41 may be appropriately affixed by adhesives means or the like to the bottom of tray 2*f*, it is preferable that they be an integral molded part of the tray bottom. It will be noted that the spikes 35, 37, 39 and 41 are shorter than the spikes 34, 36, 38 and 40 and each pair of spikes will serve the same purpose as the supports 30 through 33 of FIG. 10, while providing a savings of material. A stack of pre-moistened sheets located within the tray 2*f* will be supported by the pairs of spikes in substantially the same manner that the support 19 of FIG. 8 supports a stack. The reliability of the pop-up type dispensing of sheets of a stack located in tray 2*f* will be greatly enhanced for the same reasons given with respect to sheets of a stack mounted on the support 19 of FIG. 2. Again the pairs of spikes may be located along the diagonals of tray 2*f*. One such pair is shown in broken lines at 34*a*–35*a***.

Figure 12:
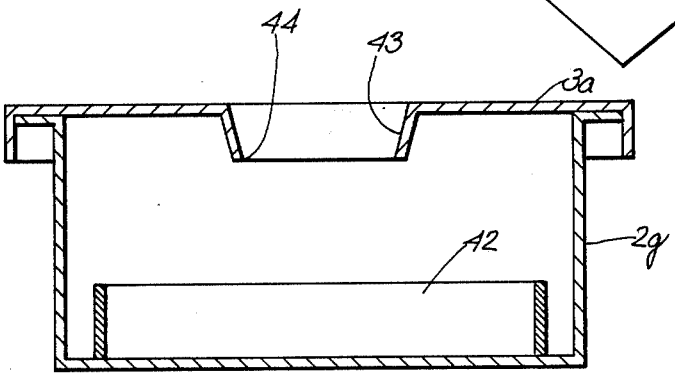
FIG. 12 is a cross sectional elevational view of a package similar to that of FIG. 1 provided with another embodiment of support means intended to raise all four of the sheet stack.

FIG. 12 illustrates yet another embodiment of the present invention. In FIG. 12 a tray **2*g* is shown and for purposes of this description the tray 2*g* is illustrated as being the same as tray 2 of FIG. 1. Located within tray 2*g* is a support means 42 in the form of an annular ring having an outside diameter of slightly less than the width of tray 2*g*. It will be evident that the ring 42 will raise all four sides of a sheet stack located within the tray, in much the same manner as the support 19 of FIG. 8**.

Ring 42 may constitute a separate element simply located within tray **2*g* prior to the placement of a sheet stack therein. On the other hand, ring 42 may be a separate element appropriately affixed or adhered to the bottom of tray 2*g*. Finally, the ring 42 may constitute an integral one-piece part of the tray 2*g***.

While the present invention is directed to the pop-up type dispensing of discrete sheet arranged in an interleaved stack, as indicated above the invention is not restricted to the use of pre-moistened sheets. Furthermore, the invention is not limited to any particular type, size or shape of dispensing orifice for the package. To illustrate this, the tray **2*g* of FIG. 12 is shown provided with a cover member 3*a* similar to cover member 3 of FIG. 1. In this instance, however, the cover member is provided with an annular, inwardly and downwardly depending flange 43 defining a dispensing orifice 44. The dispensing orifice is again of circular configuration, but it is of larger diameter than the orifice 7 of FIG. 1. The dispensing orifice may have any desired form and shape. It may even constitute a slot extending part way or completely across the cover member 3*a***.

EXAMPLE

The stiffness of the sheets of the type described herein can be related to the force required to deform them. Based on this principle, the force required to drive a series of sheets of different stiffness through the same opening can be used as a convenient measure of the stiffness of the sheets.

For purposes of demonstration, the open end of a beaker was used as the opening through which the sheets were driven. The beaker had a cylindrical body with an inside diameter of 2.5 inches. At its upper end, the top ⅜ inch of the beaker flared upwardly and outwardly to an inside diameter of 3¼ inches. The handle of a conventional spatula was used as a plunger to force each sheet through the opening of the beaker. The beaker and spatula were obtained from the Fisher Scientific Company, the beaker having part number 2-545E and the spatula having part number 14-365C.

A 10×10 inch sample of each sheet for which a measure of stiffness was desired was placed horizontally and centered over the beaker opening. The plunger or spatula was lowered into the opening at a rate of 12.5 inches per minute, pushing the sheet into the beaker. The force required to deform the sheet was measured in grams by an Instrom Universal Testing Instrument, Model TM 1102, a force testing device manufactured by the Instrom Corporation, Canton, Mass. The maximum force recorded during the deformation of a sheet was used as the measure of the stiffness of that sheet. This data was then correlated with results from dispensing tests.

All of the sheets tested were nonwoven rayon differing only in the mode of their manufacture, fiber orientation, acrylic binders used therein and the like. The various types of sheets, when impregnated with a light oil, exhibited stiffness values in the range of from about 100 to about 500 grams. Sheets of the same materials were thereafter subjected to dispensing tests. For this purpose, containers of the type described in the above mentioned copending application Ser. No. 711,929 were used. Such a container is illustrated in FIG. 1 herein. The containers were 3 inches wide 3 inches long and 1.5 inches high. Each container had a circular dispensing orifice 7 which was 3/16 inch in diameter (i.e., an opening area of 0.0276 square inch). The nonwoven rayon sheets dispensed therefrom were 2½ inches by 5 inches and of a thickness of about 0.005 inch (i.e. a cross sectional area of about 0.0125 square inch, two sheets having a total cross sectional area of about 0.025 square inch). Thus, the dispensing orifice 7 was so sized as to permit without undue friction the passage of two of the sheets in tightly gathered condition. The sheets were pre-moistened with a volatile compound in the form of a light oil.

In a first test, the sheets were dispensed from a container of the type shown in FIG. 1, the container having a flat bottom and not being provided with support means for the stack to configure the stack in the manner described above. The results of this test are set forth in Table I below.

TABLE I

| DISPENSING WITHOUT STACK SUPPORT ASSIST | | |
|---|---|---|
| SHEET STIFFNESS IN GRAMS | % SHEET FAILURES | % CONTAINERS HAVING FAILURES |
| 103 | 0 | 0 |
| 113 | 0.6 | 10 |
| 128 | 0.4 | 10 |
| 144 | 2.7 | 50 |
| 201 | 7.5 | 95 |
| 278 | 27.5 | 100 |
| 330 | 47.9 | 100 |
| 475 | 79.2 | 100 |

As indicated in the column headed SHEET STIFFNESS IN GRAMS, eight different types of nonwoven rayon sheets were used and the stiffness value for each type of sheet is given. For each type of sheet, 20 containers, each having a stack of 24 interleaved sheets, were used. The containers were not sealed so that when a failure occurred the container was opened and the next succeeding sheet restarted. In this manner, the entire stack of each container was dispensed. The column of Table I above, headed "% SHEET FAILURES" shows for the total number of sheets of a given stiffness dispensed, the percentage of sheets which failed to achieve their proper pop-up position. The column of Table I above which is headed "% CONTAINERS HAVING FAILURES" indicates the percent of containers for each type of sheet demonstrating a dispensing failure.

Thus, for sheets having a stiffness of 103 grams, there were no sheet failures and no containers demonstrating a dispensing failure. On the other hand, for sheets demonstrating a stiffness of 475 grams, 79.2% of all of the sheets dispensed failed to achieve their proper pop-up position and all of the containers provided with such sheets demonstrated dispensing failures. In those containers provided with sheets demonstrating a stiffness of 278 grams, 27.5% of all the sheets withdrawn from the containers failed to achieve their proper pop-up position and 100% of the containers demonstrated dispensing failures.

In a second test, containers of the type shown in FIG. 1 were provided with stack supports of the type shown in FIG. 8. Again, each container was supplied with a stack of 24 interleaved 2½ inch by 5 inch sheets. The containers were not sealed so that when a failure occurred the container could be opened and the next succeeding sheet restarted. In this manner all of the sheets of the stack in each container were dispensed.

Rayon nonwoven sheets demonstrating a stiffness of 248 grams, 278 grams, 330 grams and 475 grams were used. Ten containers were tested for each type of sheet, with the exception of those sheets demonstrating 475 grams stiffness for which seven containers were tested. For each type of sheet the containers were sequentially numbered. For each container the 24 interleaved sheets of its stack were also sequentially numbered. The results of the dispensing test are summarized in Table II below.

TABLE II

| DISPENSING WITH STACK SUPPORT OF THE TYPE SHOWN IN FIG. 8 | | | | |
|---|---|---|---|---|
| CONTAINER # | 248 gm. SHEETS | 278 gm. SHEETS | 330 gm SHEETS | 475 gm. SHEETS |
| 1 | — | 24 | 20 | 22,24 |
| 2 | — | — | — | 21,22 |
| 3 | — | — | 20 | 21 |
| 4 | — | 24 | 23,24 | 19,22,23,24 |
| 5 | — | — | 23 | 20,24 |
| 6 | — | — | 23,24 | 20,24 |
| 7 | — | — | 21,22 | 20,24 |
| 8 | — | 24 | 22 | 23,24 |
| 9 | — | 24 | 21,22 | |
| 10 | — | 24 | — | |

In Table II a column is provided for each type of sheet. In that column, the designated number of each sheet which failed to achieve its proper pop-up position is given. For those 10 containers provided with stacks of sheets having a stiffness of 248 grams, all 10 containers were failure free. Of those containers provided with sheets having a 278 gram stiffness only 5 of the 10 containers had a failure and in each instance it was the last sheet of the stack. It will be noted from Table I above that when sheets having the same 278 gram stiffness were tested, 100% of the containers had a dispensing failure and 27.5% of all of the sheets dispensed failed to achieve their proper pop-up position.

Returning to Table II, when sheets having a stiffness of 330 grams were tested, two of the 10 containers had no failures. Four of the containers had a single sheet failure and four of the containers had a two sheet failure. All of the failing sheets were near the bottom of the stack.

Finally, when sheets having a stiffness of 475 grams were used, all 7 of the containers tested had dispensing failures, the majority demonstrating two sheet failures. Again, most of the failures were near the bottom of the stack.

From the above data it will be noted that a container of the type shown in FIG. 1, when not provided with a support to configure the stack in the manner taught above, can be expected to demonstrate dispensing failures with sheets having a stiffness above about 113 grams. When the same containers are provided with stack-configuring supports, sheets having a stiffness up to at least 248 grams can be dispensed without failure. With sheets having a stiffness of 278 grams, only the final sheet of the stack failed and this occurred with only 50% of the containers. Failure near the end of the stack with very stiff sheets such as those having a stiffness of 330 grams or 475 grams is believed attributable to the fact that these stiffer sheets have the ability to recover from the configuration given to the stack by the support as the stack is depleted and are capable of supporting themselves in a substantially planar configuration, rendering the stack support ineffective for the last few sheets.

Modifications may be made in the invention without departing from the spirit of it. For example, the supports 15 through 18 of FIG. 7 could be replaced by pairs of spikes similar to those illustrated in FIG. 11. It would also be within the scope of the invention to provide resilient means, spring means or the like to urge supports of the type shown in FIGS. 2, 6 and 8 toward the cover 3 of the package. In this way, room permitting the lifting or formation of a "bubble" by a succeeding subsequent sheet within the package 1 would be eliminated or minimized throughout the dispensing of an entire stack of interleaved sheets. In all of the embodiments of the present invention, the support means (used to raise two opposite sides or all four sides of the stack) should be so configured with respect to the tray 2 of the package that during a high speed packaging operation the stack is adequately contained within the tray.

The embodiments of the invention in which an exclusive property or privilege is claimed are defined as follows:

1. In a pop-up type dispensing package containing an interleaved stack of discrete, rectangular, stiff sheets and having a dispensing orifice above said stack, the improvement comprising means within said package to shape said sheet stack so as to have a central depressed portion with the interleaved portions of the sheets being non-planar and concave to improve the reliability of the pop-up type dispensing of said sheets, said package comprising a tray having four sides and a bottom to contain said stack and a cover for said tray having said dispensing orifice therein, said bottom of said tray constituting an integral part of said tray and comprising said means to shape said sheet stack, said bottom of said tray having a support surface for said stack which slopes inwardly and downwardly from each of said four tray sides.

2. In a pop-up type dispensing package containing an interleaved stack of discrete, rectangular, stiff sheets and having a dispensing orifice above said stack, the improvement comprising means within said package to shape said sheet stack so as to have a central depressed portion with the interleaved portions of the sheets being non-planar and concave to improve the reliability of the pop-up type dispensing of said sheets, said package comprising a tray having four sides and a bottom to contain said stack and a cover for said tray having said dispensing orifice therein, said means to shape said stack comprising a separate support locatable within said package beneath said sheet stack, said support having a supporting surface sloping downwardly and inwardly from each of said tray sides toward the center of said tray.

3. In a pop-up type dispensing package containing an interleaved stack of discrete, rectangular, stiff sheets and having a dispensing orifice above said stack, the improvement comprising support means within said package to shape said sheet stack so as to have a central depressed portion with the interleaved portions of the sheets being non-planar and concave in two vertical planes which intersect each other at the verticalaxis of the package and lie at an angle of 90° to each other, said support means being configured to elevate four sides of said sheet stack above the central portion thereof, whereby to improve the realability of the pop-up type dispensing of said sheets.

* * * * *

UNITED STATES PATENT OFFICE

CERTIFICATE OF CORRECTION

PATENT NO. : 4,166,551

DATED : September 4, 1979

INVENTOR(S) : Paul Stiros

It is certified that error appears in the above-identified patent and that said Letters Patent are hereby corrected as shown below:

Column 1, line 18, change "follows" to---follow---.

Column 8, line 49, change "insect-type" to---insert-type---.

Column 9, line 34, "supportthe" should read---support described with respect to FIGS. 8 and 9. In FIG. 10 a tray 2e is illustrated. Tray 2e is essentially the---.

Column 9, line 58, "adhesives" should read---adhesive---.

Column 14, line 34, "verticalaxis" should read---vertical axis---.

Signed and Sealed this

*Twenty-fifth* Day of *December 1979*

[SEAL]

*Attest:*

SIDNEY A. DIAMOND

*Attesting Officer*

*Commissioner of Patents and Trademarks*